US010398623B2

(12) United States Patent
Hatley

(10) Patent No.: US 10,398,623 B2
(45) **Date of Patent: *Sep. 3, 2019**

(54) MULTI-PUMP HOT TUB PLUMBING SYSTEM

(71) Applicant: LPI, Inc., Johnson City, TN (US)

(72) Inventor: David E. Hatley, Gray, TN (US)

(73) Assignee: LPI, Inc., Johnson City, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/976,367

(22) Filed: May 10, 2018

(65) Prior Publication Data

US 2018/0256447 A1 Sep. 13, 2018

Related U.S. Application Data

(62) Division of application No. 15/187,084, filed on Jun. 20, 2016, now Pat. No. 9,993,387.

(60) Provisional application No. 62/182,174, filed on Jun. 19, 2015.

(51) Int. Cl.

| | |
|---|---|
| ***A61H 33/00*** | (2006.01) |
| ***A61H 33/02*** | (2006.01) |
| ***A61H 33/06*** | (2006.01) |

(52) U.S. Cl.

CPC ..... *A61H 33/0087* (2013.01); *A61H 33/60* (2013.01); *A61H 33/063* (2013.01); *A61H 2033/022* (2013.01); *A61H 2201/5002* (2013.01)

(58) Field of Classification Search

CPC ..... A61H 33/0087
USPC ..... 4/541.1–541.3
See application file for complete search history.

(56) References Cited

U.S. PATENT DOCUMENTS

| | | | | |
|---|---|---|---|---|
| 4,853,987 | A | 8/1989 | Jaworski | |
| 5,038,853 | A * | 8/1991 | Callaway, Sr. | H02K 9/19 165/46 |
| 5,056,168 | A | 10/1991 | Mersmann | |
| 5,156,642 | A † | 10/1992 | Lopez | |
| 5,199,116 | A | 4/1993 | Fischer | |
| 5,474,102 | A † | 12/1995 | Lopez | |
| 5,742,954 | A | 4/1998 | Idland | |
| 6,000,073 | A | 12/1999 | Eddington | |
| 6,108,829 | A | 8/2000 | Wadsworth | |
| 6,412,123 | B1 | 7/2002 | Lau | |
| 6,681,414 | B1 † | 1/2004 | May | |
| 6,857,967 | B2 | 2/2005 | Loyd et al. | |
| 7,089,608 | B2 | 8/2006 | Erb | |
| 8,104,110 | B2 | 1/2012 | Caudill et al. | |
| 8,453,275 | B2 * | 6/2013 | May | A61H 33/005 4/507 |
| 8,890,357 | B2 | 11/2014 | Campbell | |

(Continued)

FOREIGN PATENT DOCUMENTS

| | | |
|---|---|---|
| AU | 197352361 | 10/1974 |
| EP | 2736295 | 5/2014 |
| GB | 1415627 | 11/1975 |

*Primary Examiner* — Lori L Baker
(74) *Attorney, Agent, or Firm* — Pitts & Lake, P.C.

(57) ABSTRACT

A hot tub plumbing system including a plurality of water pumps respectively provided at different sides of a hot tub having a plurality of jets, and a plurality of manifolds each having an intake port coupled to one of the water pumps, and each configured to have a plurality of output ports respectively connected by tubing to one of the jets of the hot tub.

8 Claims, 8 Drawing Sheets

(56) References Cited

U.S. PATENT DOCUMENTS

| | | | | |
|---|---|---|---|---|
| 9,475,210 | B2 * | 10/2016 | Koski | B28D 7/02 |
| 9,993,387 | B2 * | 6/2018 | Hatley | A61H 33/0087 |
| 2008/0148471 | A1 * | 6/2008 | Tatum | A61H 33/0087 4/541.6 |
| 2008/0189846 | A1 † | 8/2008 | Gardenier | |
| 2010/0223721 | A1 * | 9/2010 | May | A61H 33/005 4/541.1 |
| 2014/0157512 | A1 | 6/2014 | Yanity | |
| 2015/0204095 | A1 * | 7/2015 | Tournas | E04H 4/084 4/493 |

* cited by examiner
† cited by third party

MULTI-PUMP HOT TUB PLUMBING SYSTEM

CROSS-REFERENCE TO RELATED APPLICATIONS

This Application is a divisional patent application of U.S. patent application Ser. No. 15/187,084, filed Jun. 20, 2016, which claims the benefit of and priority to U.S. Provisional Patent Application Ser. No. 62/182,174, filed Jun. 19, 2015, the contents each of which are herein incorporated in their entireties by reference.

STATEMENT REGARDING FEDERALLY SPONSORED RESEARCH OR DEVELOPMENT

Not Applicable

FIELD OF INVENTION

The present invention relates to hot tubs, and more particularly, to a plumbing system for use in hot tub designs that allows for improved performance of a hot tub recirculation system.

BACKGROUND

Hot tubs, whirlpools, spas, and the like (hereinafter "hot tubs") of the type generally comprising a large tub or small pool full of heated water, are commonly used for hydrotherapy, recreation, exercise, and/or physical therapy. Many modern hot tubs include a recirculation system for passing water within the hot tub through a heater, filtration system, and/or chemical dispenser before returning the recirculated water to the interior of the hot tub. Numerous devices exist for returning recirculated water to a hot tub, and many of these return devices also provide additional utility. For example, many hot tubs incorporate jets and/or waterfall fixtures for returning recirculated water to the interior of the hot tub. Such jets may also be used to generate water flow or air flow within the hot tub and/or to direct heat and/or pressure to a user within the hot tub. Thus, such jets may be used for treatment of sore muscles, for relaxation, such as for example after exercise or rigorous physical activity, or for other recreational purposes.

A hot tub recirculation system typically includes at least one pump for driving water and/or air from the hot tub interior, through the recirculation system, and back into the hot tub. Several prior art hot tub designs operate using one or more pumps and/or electric heaters, and are configured to operate using a 220-volt power source. Such hot tub designs typically employ powerful pumps that allow for ample water pressure within the recirculation systems, such that numerous jets and other desirable recirculation fixtures may be provided within the hot tub without significant loss of water pressure throughout the recirculation system. Such pumps are typically configured for use at multiple selectable speeds, such that water may be slowly recirculated through the recirculation system for heating, and may be quickly recirculated to employ the hot tub jets. Thus, the one or more pumps may be adjusted to effectively turn the jets "on" and "off." However, significant drawbacks exist in operating this type of hot tub. For example, a traditional 220-volt hot tub often requires the installation and use of a dedicated electrical circuit to power the hot tub, the circuit typically employing a 50-amp ground fault circuit interrupter ("GFCI") circuit breaker. Such 220-volt hot tub designs are known to consume significant amounts of electrical power during operation, and accordingly, the cost to operate such hot tubs is often undesirably high.

Several other hot tub designs employ a recirculation system configured to operate using a 110-volt power source. Such hot tub recirculation systems typically include a single pump configured to drive water and/or air through the recirculation system, and may also include a heater for heating the recirculating water. However, in such 110-volt hot tub designs, the heater is typically not configured to operate at the same time as the jets are used. Thus, when the pump is switched to its fast setting, such that water and/or air is/are recirculated quickly through the jets, the heater is switched "off" Thus, in such hot tub designs, it is difficult to maintain heat within the hot tub while the jets are in use. Additionally, 110-volt hot tub designs are typically limited in the number of jets which may be operated at once. For example, because of amperage on the readily available and industry standard pumps, most 110-volt hot tub designs are limited to inclusion of only approximately 15-20 jets. By contrast, a traditional 220-volt hot tub is typically capable of operating approximately 40-45 jets at once. Recently, several hot tub manufacturers have been able to stretch the number of jets included in a 110-volt hot tub design to 25-28 jets by adding diverter valves that allow a user to switch the pump to run only half the jets at a time. Thus, in such hot tub designs, the performance of the "sets" of individual jets is still fairly good. However, such designs are not ideal in instances in which a user desires to operate all jets in the hot tub at once. For this reason, 110-volt hot tubs, though easier to install and cheaper to operate, are often considered inferior to more traditional 220-volt hot tub designs.

Thus, a hot tub that can utilize a larger number of jets while still employing a conventional 110-volt power source, while also reducing heat loss in the jetted water, would be desirable.

BRIEF SUMMARY

According to various example embodiments of the present general inventive concept, a hot tub plumbing system is provided that includes a plurality of water pumps configured so as to reduce the distance between the water pumps and the jets of the hot tub. Such a system allows water pumps with a 110-volt power source to approach the effectiveness and efficiency of a 220-volt powered system.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by a hot tub plumbing system that includes a plurality of water pumps respectively provided at different sides of a hot tub having a plurality of jets, and a plurality of manifolds each having an intake port coupled to one of the water pumps, and each configured to have a plurality of output ports respectively connected by tubing to one of the jets of the hot tub.

The plurality of water pumps may be configured to be powered by a 110-volt source.

The plurality of water pumps may include two water pumps provided on opposite sides of the hot tub.

The plurality of water pumps may include four water pumps each provided at different sides of the hot tub.

The manifolds may each be provided with two rows of output ports.

The two rows of output ports may be substantially adjacent.

The two rows of output ports may be provided at substantially opposite sides of the respective manifolds.

The output ports of the manifolds may be angled away from the input ports of the respective manifolds.

The output ports may be configured at approximately 45 degree angles to the manifold.

The water pumps may be configured to be adjacent to a shell of the hot tub to minimize a distance between the pumps and the jets supplied with water by the water pumps.

The manifolds may be attached directly to the respective water pumps.

The foregoing and/or other aspects and advantages of the present general inventive concept may also be achieved by a manifold to be used in a hot tub plumbing system, including an intake port configured to be coupled to a water pump in the hot tub plumbing system, and a plurality of output ports configured with connecting portions to connect with tubing to supply water from the water pump to a corresponding plurality of jets in the hot tub plumbing system.

The manifold may further include a plurality of friction members provided inside the manifold to cause friction with water passing through the manifold and over the friction members.

The friction members may include a plurality of projections provided to an inner surface of the manifold.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
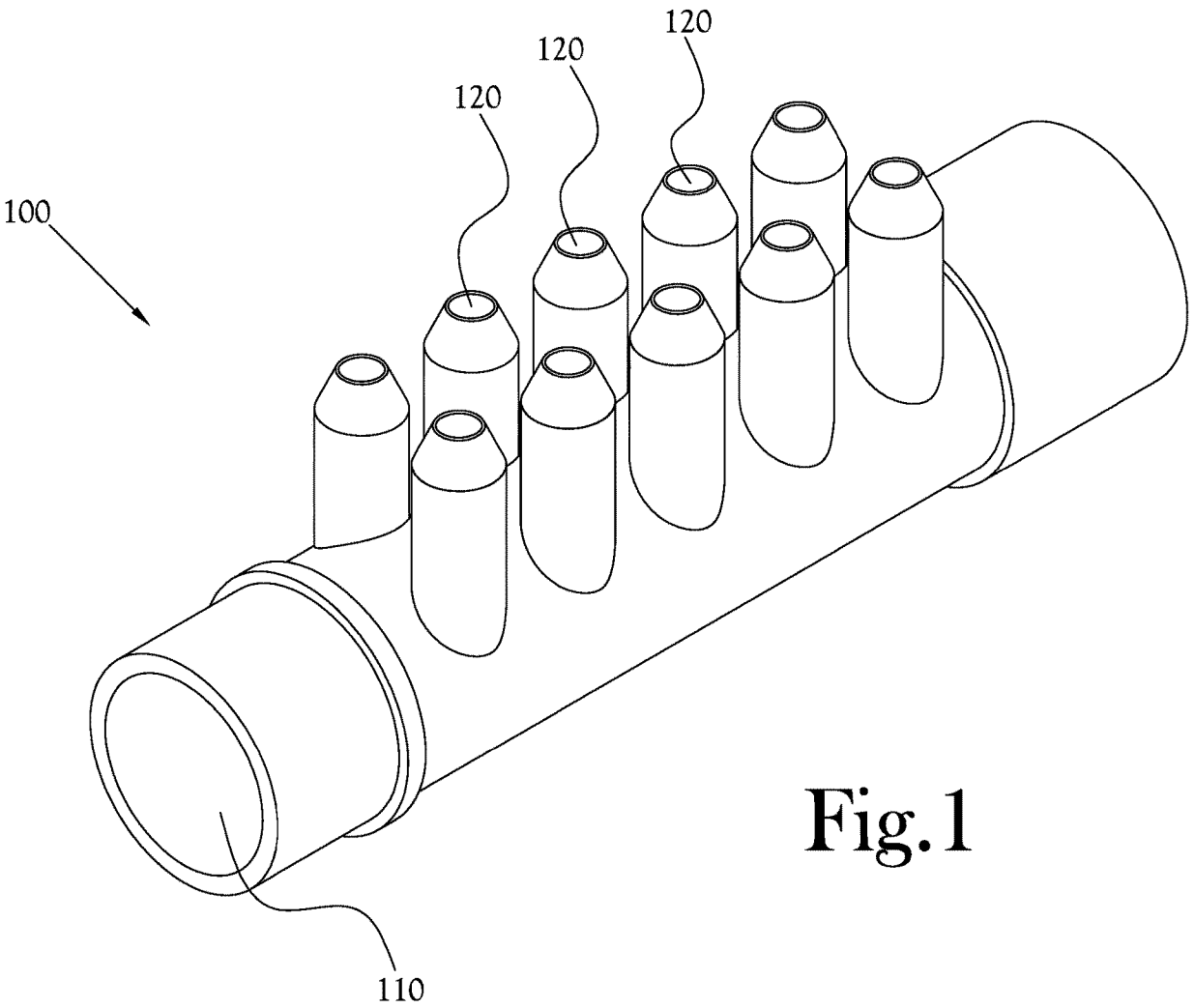
FIG. 1 illustrates an isometric view of a manifold to be used in a hot tub plumbing system according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a hot tub plumbing system is provided that includes a plurality of water pumps configured so as to reduce the distance between the water pumps and the jets of the hot tub. Such a system allows water pumps with a 110-volt power source to approach the effectiveness and efficiency of a 220-volt powered system. In one example embodiment of such a system according to the present general inventive concept, a hot tub plumbing system is provided that includes a plurality of water pumps respectively provided at different sides of a hot tub having a plurality of jets, and a plurality of manifolds each having an intake port coupled to one of the water pumps, and each configured to have a plurality of output ports respectively connected by tubing to one of the jets of the hot tub. Because the plurality of water pumps are provided that have relatively shorter paths to each of the supplied water jets, instead of a single pump that is forced to circulate water to all of the jets around the entirety of the hot tub, a hot tub powered by a 110-volt source is able to approach the effectiveness and efficiency of a conventional hot tube having a 220-volt power source. As no single water pump is responsible for pumping water to an opposite side of the tub, the length of the tubing between the pumps and the hot tub jets is considerably shortened, therefore reducing the overall travel and increasing the overall pressure coming out of the hot tub jets, thus allowing the hot tub to operate from low amp pumps. The manifolds described herein, which are respectively coupled to the plurality of water pumps, further assist in shortening the length of the tubing required to supply water to the jets. In various example embodiments, the water pumps may be placed directly adjacent the shell of the hot tub basin to further reduce the required length of tubing between the water pumps and the jets.

Figure 2:
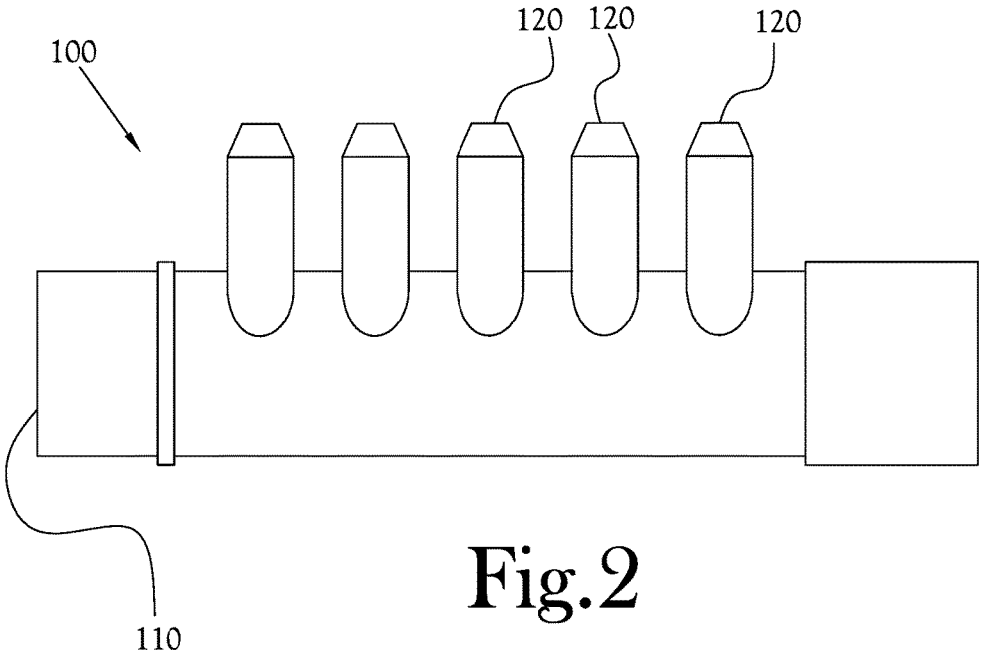
FIG. 2 illustrates an elevation view of the manifold of FIG. 1.
Figure 3:
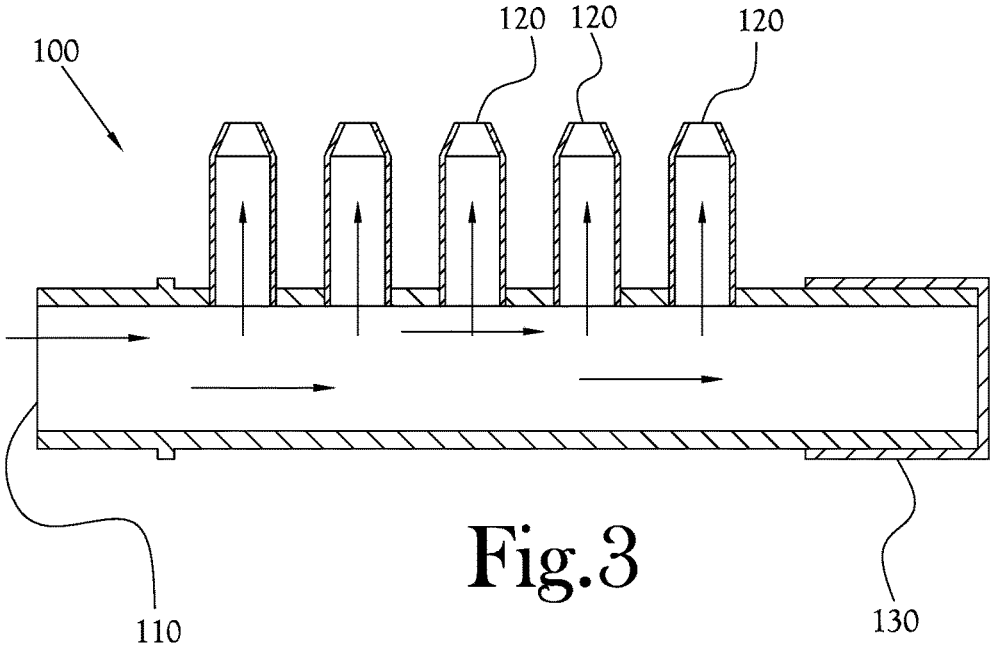
FIG. 3 illustrates a cross section of the manifold of FIG. 1.

FIG. 1 illustrates an isometric view of a manifold to be used in a hot tub plumbing system according to an example embodiment of the present general inventive concept. FIG. 2 illustrates an elevation view of the manifold of FIG. 1. FIG. 3 illustrates a cross section of the manifold of FIG. 1. The example manifold 100 of FIGS. 1-3 includes an intake port 110 at a proximal end of the manifold 100 that is configured to be coupled to a water pump of the hot tub plumbing system. In various example embodiments, the intake port 110 may be configured to be connected directly to the water pump. A distal end of the manifold is closed by a capping member 130 in the example embodiments illustrated in FIGS. 1-3, but in other example embodiments may be formed as a closed end that is continuous with the material forming the length of the manifold, with a type of inserted member, or the like. A plurality of output ports 120 are provided to output water delivered from a water pump and trough the intake port 110 to the jets of the hot tub via tubing connected to the output ports 120. As illustrated in the example embodiments of FIGS. 1-3, the output ports 120 may be configured with ends to be inserted into the tubing connecting the output ports 120 to the jets. Various other example embodiments may be configured to fit differently with the tubing without departing from the scope of the general inventive concept.

In the example embodiment illustrated in FIGS. 1-3, the outlet ports 120 are configured in two substantially adjacent rows that extend in substantially the same direction from the manifold 100. In other example embodiments, the outlet ports may be provided in a host of different configurations. For example, the outlet ports may be provided in a single row along one side of the manifold, in two rows provided on opposite sides of the manifold in mirroring or alternating configurations, and so on. Also, while the number of outlet ports 120 provided to the manifold 100 of FIGS. 1-3 is ten, various different example embodiments may include fewer or more outlet ports. In various example embodiments, the number of outlet ports may correspond to a number of jets on one or two sides of the hot tub in which the hot tub plumbing system is provided. As illustrated in FIG. 3, the water forced into the intake port 110 by the pump will then be forced through outlet ports 120 to be delivered to the jets of the hot tub.

Various different example embodiments of a hot tub plumbing system according to the present general inventive concept may have different quantities of water pumps that are powered by a 110-volt power source. For example, an example embodiment may include two 110-volt rated water pumps that together supply water to 40 jets. Another example embodiment may include four 110-volt rated water pumps that together supply water to 46 jets. Because a plurality of water pumps are provided in the present general inventive concept, no one water pump needs to be responsible for pumping water to jets on an opposite side of the hot tub. In other words, the "no travel" plumbing system of the present general inventive concept avoids the requirement of the water circling around through all of the jets of the hot tub, which is the arrangement in the conventional 110-volt spa. Thus, a hot tub is provided that is made for both high water flow and low amperage requirements. The plurality of water pumps configured in this manner allows the hot tub to perform properly and similar to a 220-volt spa.

Figure 4:
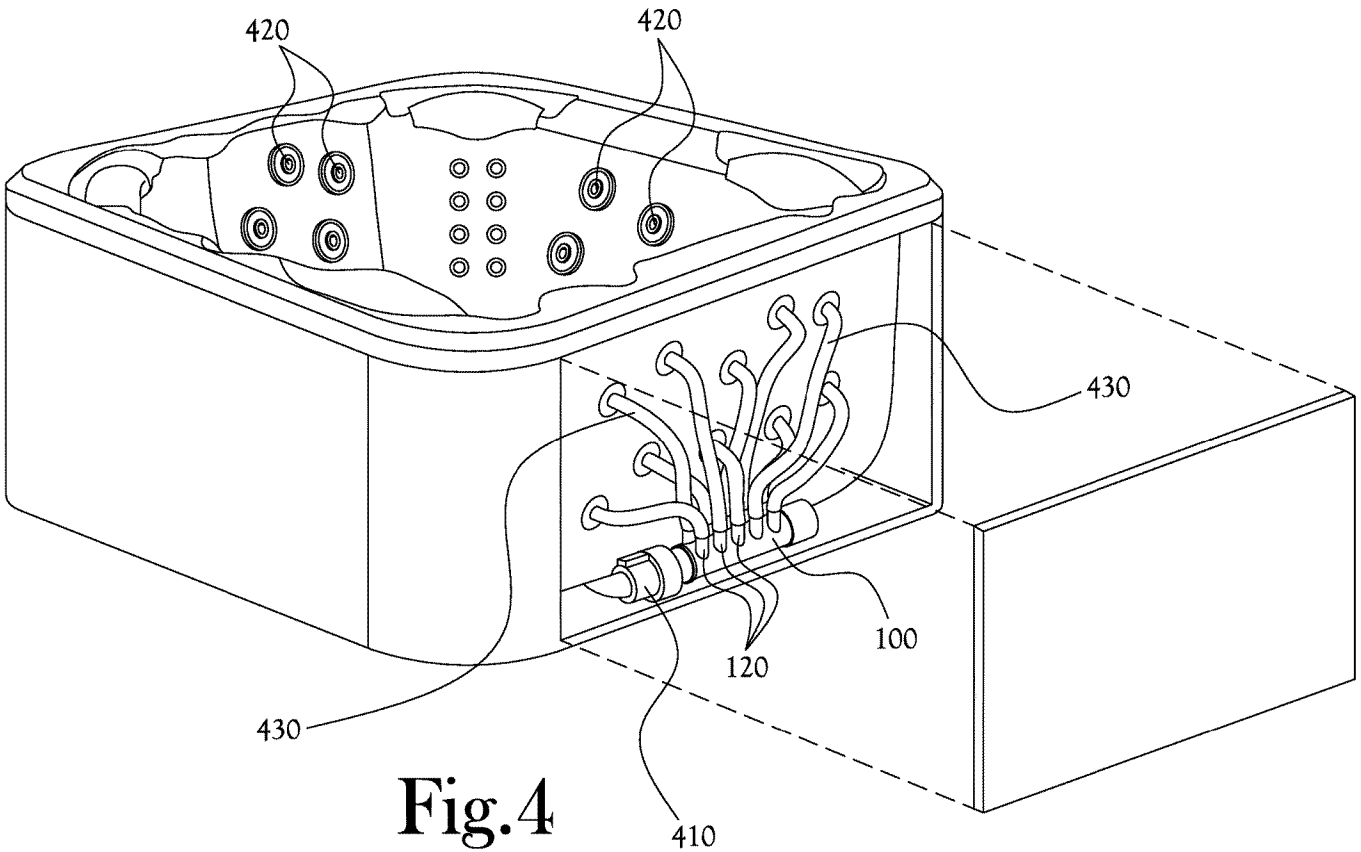
FIG. 4 illustrates a hot tub plumbing system according to an example embodiment of the present general inventive concept.

FIG. 4 illustrates a hot tub plumbing system according to an example embodiment of the present general inventive concept. In the example embodiment illustrated in FIG. 4, the manifold 100 of FIGS. 1-3 is coupled to a pump 410 that provides water solely to the jets 420 provided on one side of the hot tub. Each of the jets 420 on one side of the hot tub receives water from the corresponding manifold through tubing 430 extending from the output ports 120 to the respective jets 430. Although not illustrated, the example hot tub plumbing system of FIG. 4 includes one such pump 410, manifold 100, tubing 430, and jets 420 arrangement on each side of the hot tub. The water pump 410 and/or manifold 100 are placed adjacent to the shell of the hot tub to minimize the distance between the pump and the jets 420 supplied with water by the water pump 410. In other words, by placing the pump 410 and/or manifold 100 by the basin of the hot tub, just opposite the inner surface of the tub, rather than closer to the outer casing of the hot tub, more distance between the pump 410 and the jets 420 is eliminated.

Figure 5:
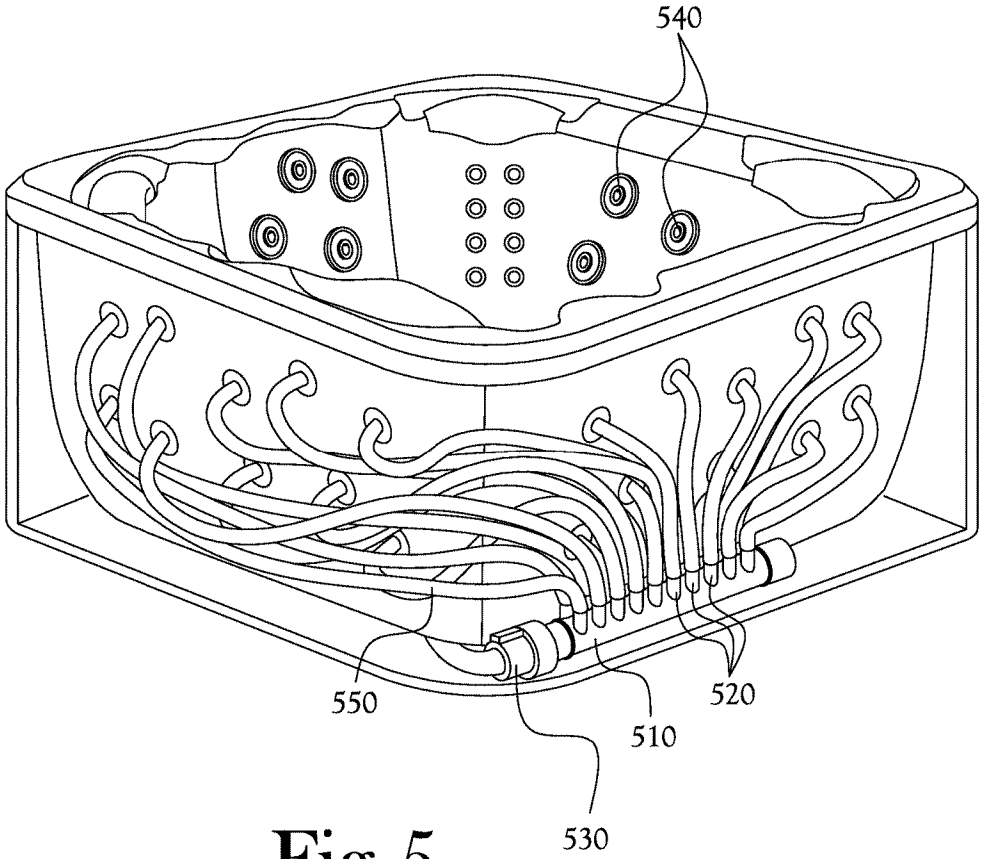
FIG. 5 illustrates a hot tub plumbing system according to another example embodiment of the present general inventive concept.

FIG. 5 illustrates a hot tub plumbing system according to another example embodiment of the present general inventive concept. In the example embodiment illustrated in FIG. 5, the manifold 510 is provided with a larger number of output ports 520 so that the manifold 510 can route water from a connected water pump 530 to all of the jets 540 on two adjacent sides of the hot tub. In this type of embodiment, two water pump and manifold assemblies are provided to the hot tub plumbing system, and each of the assemblies supplies water through tubing 550 to the jets 540 of two adjacent sides of the hot tub. Therefore, as the example embodiment illustrated in FIG. 4 includes four water pump and manifold assemblies each responsible for supplying water to the jets of one corresponding side of the hot tub, and the example embodiment illustrated in FIG. 5 includes two water pump and manifold assemblies each responsible for supply water to the jets of two corresponding and adjacent sides of the hot tub, neither of the plumbing systems according to the present general inventive concept includes a pump that is responsible for supplying water to the entirety of jets of the hot tub. Further, neither of the example embodiments of FIGS. 4-5 include water pumps that are responsible for supplying water to jets at a side of the hot tub that is opposite to the side at which the water pump is provided. In the example embodiment illustrated in FIG. 5, the farthest jet 540 from the water pump 530 would be the endmost jet 540 at a side adjacent to the side at which the water pump 530 is provided. Although not illustrated, various example embodiments of the present general inventive concept may include a water pump and manifold assembly that is provided at one side of the hot tub, such as at a central portion of the one side of the hot tub, that supplies water to the jets provided on that side of the hot tub plus the nearest half of the jets on both sides of the hot tub that are adjacent to the side at which the water pump and manifold assembly are provided. In other words, in such an example embodiment, two water pump and manifold assemblies may be provided to the hot tub plumbing system, one each on opposite sides of the hot tub, and each assembly is responsible for the jets on the entirety of their corresponding sides and half of the jets on each of the adjacent sides. Again, in such an example embodiment, neither of the water pumps is required to supply water to jets on an opposite side of the hot tub.

Figure 6:
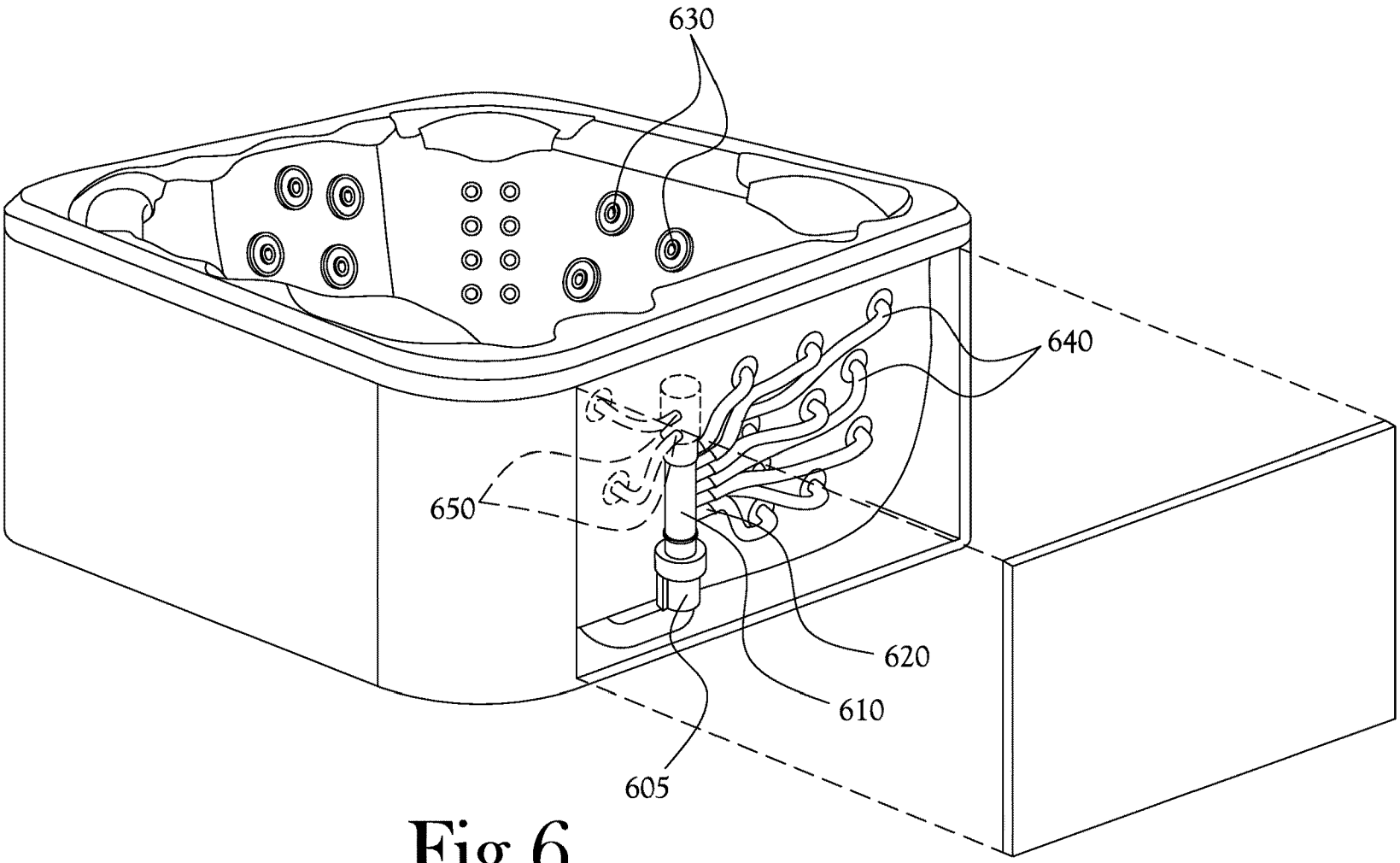
FIG. 6 illustrates a hot tub plumbing system according to yet another example embodiment of the present general inventive concept.

FIG. 6 illustrates a hot tub plumbing system according to yet another example embodiment of the present general inventive concept. In the example embodiment illustrated in FIG. 6, a single water pump 605 and manifold 610 are provided for each side wall of the hot tub, which is similar to the arrangement illustrated in FIG. 4. However, in the example embodiment illustrated in FIG. 6 the manifold 610 is configured in a vertical arrangement to shorten the required length of the tubing 640 connecting the outlet ports 620 of the manifold 610 to the jets 630. Therefore, by arranging the manifold 610 in the vertical configuration, more water pressure may be maintained between the water pump 605 and the jets 630. In example embodiments in which the manifold is illustrated in the vertical orientation, the water pump may or may not also be arranged in a vertical orientation. The example embodiment illustrated in FIG. 6 also includes an extension 650 provided to the manifold 610 to provide water through the tubing 640 to additional jets that were not supplied water from the outlet ports 620 provided to the main body of the manifold 610. In other words, in a case in which there are more jets at one side of the hot tub than there are outlet ports 620 provided to the manifold, an extension 650 in the form of a cap or the like may be attached to the manifold 610 (which may also include opening the distal end of the manifold 610), and the extension 650 equipped with tubing through outlet ports similar to the other outlet ports 620 of the manifold 610, or directly to the extension 650, etc. It is noted that while the extension 650 is illustrated as part of the vertically arranged manifold 610, this is simply to illustrate the possibility of adding an extension 650 to any of the described manifold configurations in these descriptions, and such an extension is not restricted, nor necessary, to vertically arranged manifolds included in example embodiments of the present general inventive concept.

Also, while not illustrated, in various other example embodiments of the present general inventive concept in which the manifold is configured in a vertical orientation, the manifold may be configured to have one row of outlet ports provided on opposite sides of the manifold. Such a configuration allows the manifold to be placed at or near the middle of the side wall of the hot tub, with the outlet ports each pointing away in two directions to further reduce the length of tubing between the outlet ports and the jets. This decreases the distance between the water pump and the jets such that the longest distance between any jet and the water pump may be one half of one side of the hot tub.

Figure 7:
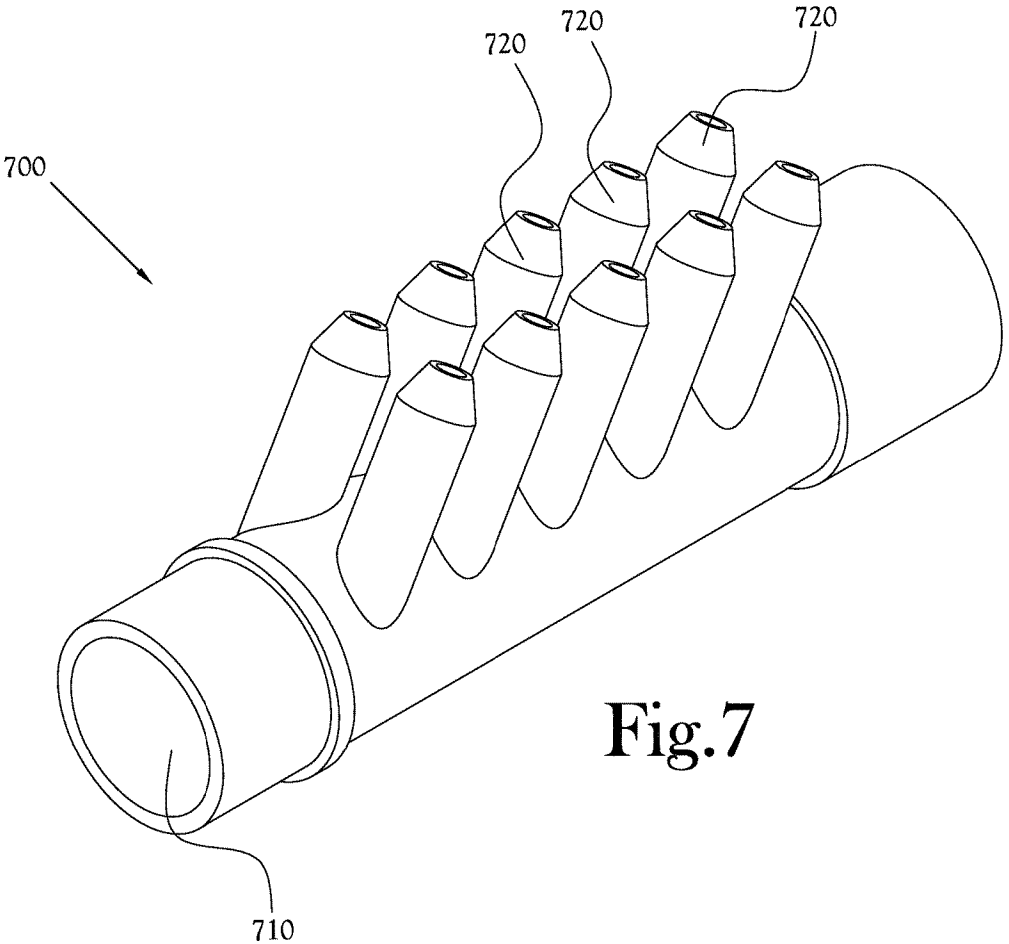
FIG. 7 illustrates an isometric view of a manifold to be used in a hot tub plumbing system according to another example embodiment of the present general inventive concept.
Figure 8:
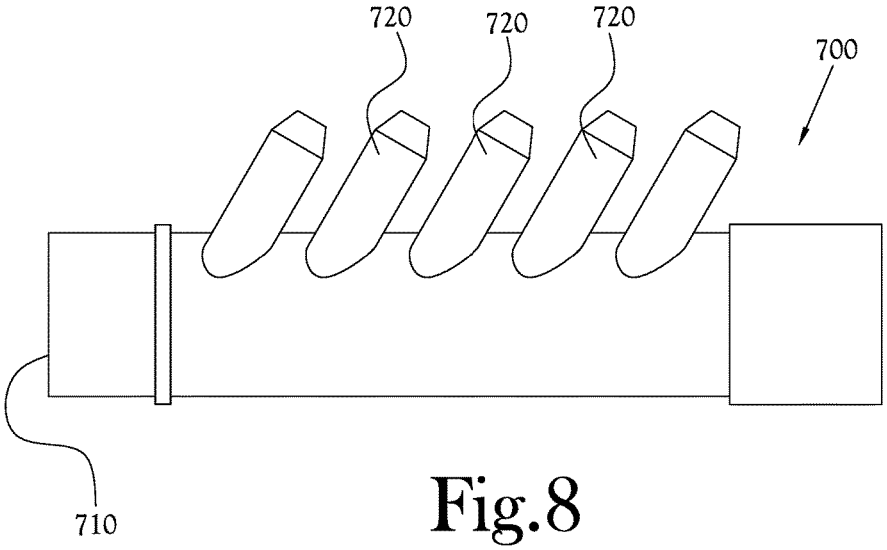
FIG. 8 illustrates an elevation view of the manifold of FIG. 7.
Figure 9:
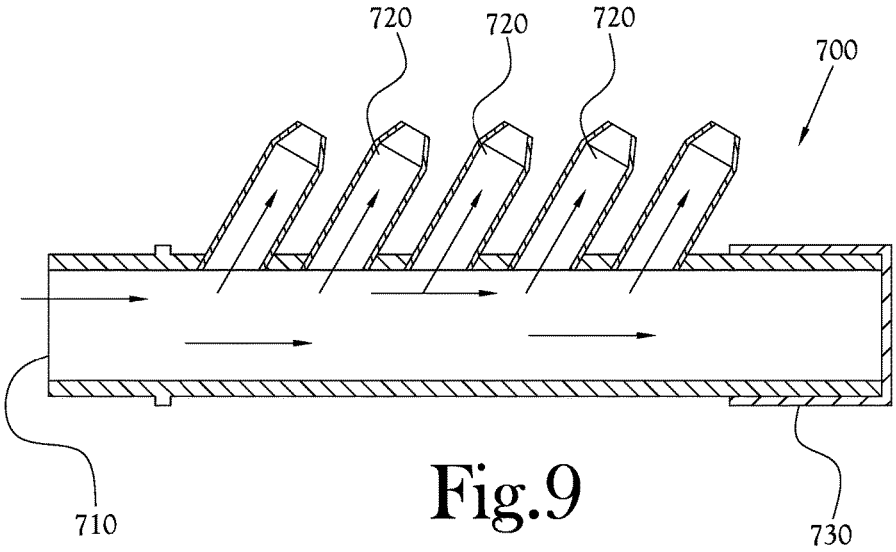
FIG. 9 illustrates a cross section of the manifold of FIG. 7.

FIG. 7 illustrates an isometric view of a manifold to be used in a hot tub plumbing system according to another example embodiment of the present general inventive concept. FIG. 8 illustrates an elevation view of the manifold of FIG. 7. FIG. 9 illustrates a cross section of the manifold of FIG. 7. The example manifold 700 of FIGS. 7-9 is similar in configuration to the manifold 100 of FIGS. 1-3, except that the outlet ports 720 are configured at an angle relative to the overall body of the manifold 700. In more detail, the outlet ports 720 are angled away from the intake port 710, and therefore away from the water pump, so as to increase the ease of flow of the water. As the outlet ports 120 of the manifold 100 illustrated in FIG. 1 are provided at roughly 90 degree angles relative to the flow of water through the main body of the manifold 100, the water also has to make the 90 degree turn. By angling the outlet ports 720, the water does not have to make the 90 degree turn, and therefore flows more easily and maintains more water pressure to be transferred to the jets of the hot tub. This allows for the water to go to the jets in a more natural trajectory and unrestricted from turning corners or other obstacles that may be caused by a manifold in which the outlet ports are not angled. In various example embodiments of the present general inventive concept, the outlet ports 720 are configured at 45 degree angles relative to the main body of the manifold 700.

Similar to the example embodiment illustrated in FIGS. 1-3, the outlet ports 720 are configured in two substantially adjacent rows that extend in substantially the same direction from the manifold 100. In other example embodiments, the outlet ports may be provided in a host of different configurations. For example, the outlet ports may be provided in a single row along one side of the manifold, in two rows provided on opposite sides of the manifold in mirroring or alternating configurations, and so on. Also, while the number of outlet ports 720 provided to the manifold 700 of FIGS. 7-9 is ten, various different example embodiments may include fewer or more outlet ports. In various example embodiments, the number of outlet ports may correspond to a number of jets on one or two sides of the hot tub in which the hot tub plumbing system is provided.

Figure 10:
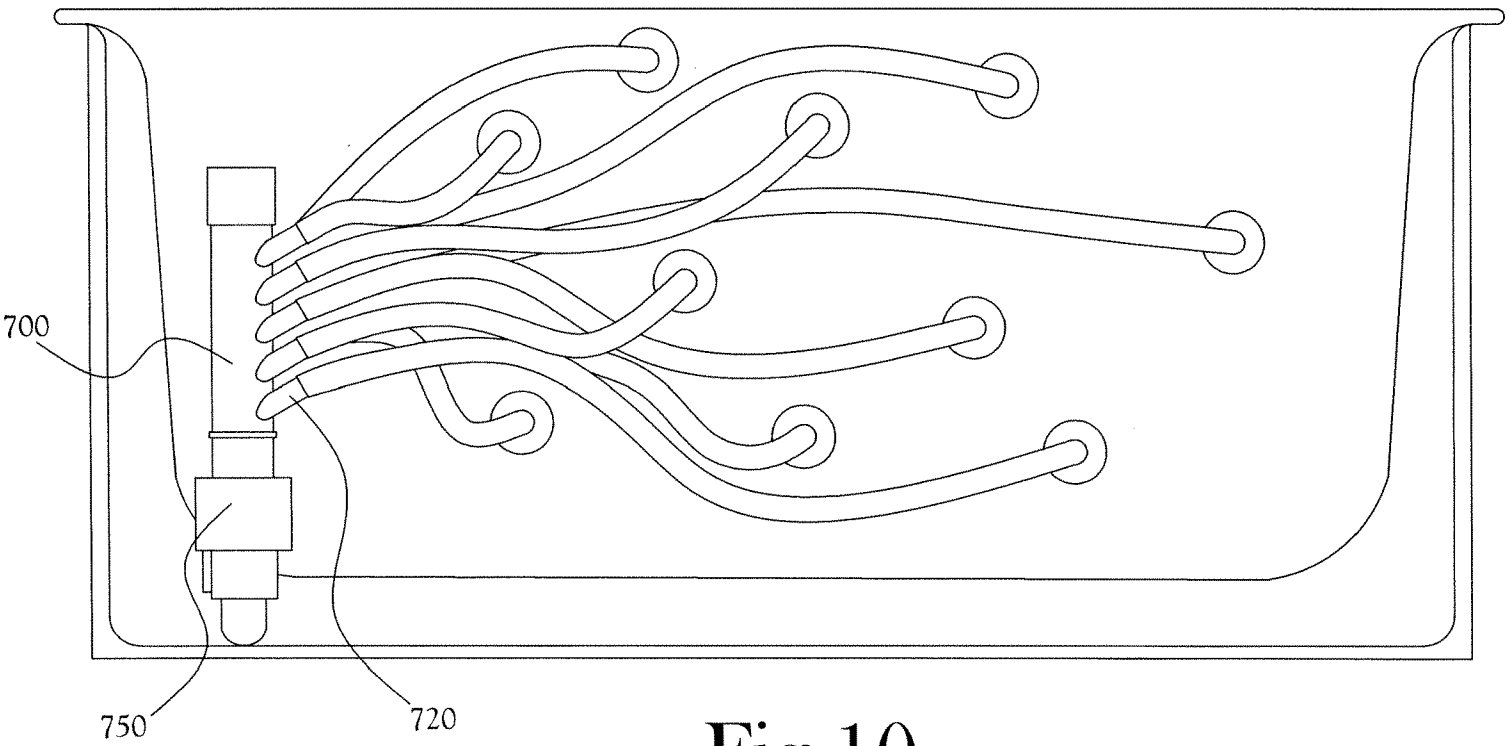
FIG. 10 illustrates a hot tub plumbing system according to still another example embodiment of the present general inventive concept.

FIG. 10 illustrates a hot tub plumbing system according to still another example embodiment of the present general inventive concept. The hot tub plumbing system illustrated in FIG. 10 includes the manifold 700, as illustrated in FIGS. 7-9, in a vertical orientation with the outlet ports 720 angled upward so that the flow of water is not subjected to 90 degree turns while leaving the manifold 700. The pump 750 is connected directly to the manifold 700 and is also configured in a vertical orientation, though in other example embodiments the pump may be oriented differently, or may be coupled to the manifold 700 by a coupling member, rather than connected directly thereto.

In various example embodiments of the present general inventive concept, loss of heat of the pumped water may be reduced by employing a friction manifold in which a plurality of friction members are provided inside the manifold to cause friction with water passing through the manifold and over the friction members. The interaction of the water with the friction members causes heat, and therefore replaces at least some of the heat that may be lost due to the hot tub plumbing system being powered by a 110-volt source that limits the operation of the water heater. The friction members may include a plurality of projections provided to an inner surface of the manifold. The friction and heating action are increased when the water pumps are operating at high speed, thus using a natural friction heat to help maintain the spa set temperature while the unit is in use.

Various example embodiments of the present general inventive concept improve the performance of a 110-volt powered hot tub by restricting travel distance and 90 degree turns of water flow, multiple strategically placed water pumps, and friction manifolds to aid in cooling problems that may be encountered in other 110-volt systems. The use of multiple low-amperage pumps, placed adjacent the basin of the hot tub, such as directly behind the spa seats, presents numerous advantages as compared to conventional systems, which use a single high amperage pump and in which the entire spa is plumbed in a circle pattern that cycles water through the entire unit.

According to various example embodiments of the present general inventive concept, a hot tub plumbing system may be provided that includes a plurality of water pumps respectively provided at different sides of a hot tub having a plurality of jets, and a plurality of manifolds each having an intake port coupled to one of the water pumps, and each configured to have a plurality of output ports respectively connected by tubing to one of the jets of the hot tub. The plurality of water pumps may be configured to be powered by a 110-volt source. The plurality of water pumps may include two water pumps provided on opposite sides of the hot tub. The plurality of water pumps may include four water pumps each provided at different sides of the hot tub. The manifolds may each be provided with two rows of output ports. The two rows of output ports may be substantially adjacent. The two rows of output ports may be provided at substantially opposite sides of the respective manifolds. The output ports of the manifolds may be angled away from the input ports of the respective manifolds. The output ports may be configured at approximately 45 degree angles to the manifold. The water pumps may be configured to be adjacent to a shell of the hot tub to minimize a distance between the pumps and the jets supplied with water by the water pumps. The manifolds may be attached directly to the respective water pumps.

According to various example embodiments of the present general inventive concept, a manifold to be used in a hot tub plumbing system may be provided that includes an intake port configured to be coupled to a water pump in the hot tub plumbing system, and a plurality of output ports configured with connecting portions to connect with tubing to supply water from the water pump to a corresponding plurality of jets in the hot tub plumbing system. The manifold may be configured to have two rows of output ports. The two rows of output ports may be substantially adjacent. The two rows of output ports may be provided at substantially opposite sides of the manifold. The output ports of the manifold may be angled away from the input port of the manifold. The output ports may be configured at approximately 45 degree angles to the manifold. The manifold may be configured to be attached directly to the water pump. The manifold may further include a plurality of friction members provided inside the manifold to cause friction with water passing through the manifold and over the friction members. The friction members may include a plurality of projections provided to an inner surface of the manifold.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering and medical judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A manifold for use in a hot tub plumbing system, comprising:

an intake port configured to connect to a water pump in the hot tub plumbing system; and a plurality of output ports configured with connecting portions to connect with tubing to supply water from the water pump to a corresponding plurality of jets in the hot tub plumbing system.

2. The manifold of claim 1, wherein the manifold is configured with two rows of output ports.

3. The manifold of claim 2, wherein the two rows of output ports are adjacent.

4. The manifold of claim 2, wherein the two rows of output ports are arranged at opposite sides of the manifold.

5. The manifold of claim 1, wherein the output ports of the manifold are angled away from the input port of the manifold.

6. The manifold of claim 1, wherein the manifold is configured to connect directly to the water pump.

7. The manifold of claim 1, further comprising a plurality of friction members arranged inside the manifold to cause friction with water passing through the manifold and over the friction members.

8. The manifold of claim 7, wherein the friction members include a plurality of projections extending from an inner surface of the manifold.

* * * * *